US011186098B2

(12) United States Patent
Sevenich et al.

(10) Patent No.: US 11,186,098 B2
(45) Date of Patent: Nov. 30, 2021

(54) METHOD FOR LOCALLY ADJUSTING GLOSS WHILE PRINTING AN IMAGE

(71) Applicant: Océ Holding B.V., Venlo (NL)

(72) Inventors: Johannes B. M. Sevenich, Venlo (NL); Tim Frijnts, Venlo (NL); Dirk G. Peters, Venlo (NL); Carolus E. P Gerrits, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/599,930

(22) Filed: Oct. 11, 2019

(65) Prior Publication Data

US 2020/0114662 A1 Apr. 16, 2020

(30) Foreign Application Priority Data

Oct. 15, 2018 (EP) ..... 18200521

(51) Int. Cl.
*B41J 2/01* (2006.01)
*B41J 11/00* (2006.01)
*B41J 2/205* (2006.01)

(52) U.S. Cl.
CPC ..... *B41J 11/002* (2013.01); *B41J 2/2056* (2013.01)

(58) Field of Classification Search
None
See application file for complete search history.

(56) References Cited

U.S. PATENT DOCUMENTS

| | | | | |
|---|---|---|---|---|
| 4,309,452 | A | 1/1982 | Sachs | |
| 2016/0243820 | A1* | 8/2016 | Yanaka | B41J 2/2054 |
| 2017/0210145 | A1* | 7/2017 | Kubo | B41J 2/2114 |
| 2018/0029384 | A1 | 2/2018 | Totsuka | |
| 2018/0120094 | A1* | 5/2018 | Moshel | G01B 11/0625 |

FOREIGN PATENT DOCUMENTS

| | | | |
|---|---|---|---|
| EP | 1 902 834 | A1 | 3/2008 |
| EP | 3 345 767 | A1 | 7/2018 |
| WO | WO 2017/027399 | A1 | 2/2017 |

OTHER PUBLICATIONS

Search Report issued in European priority U.S. Appl. No. 18/200,521, dated Mar. 15, 2019.

* cited by examiner

*Primary Examiner* — Erica S Lin
*Assistant Examiner* — Tracey M McMillion
(74) *Attorney, Agent, or Firm* — Birch, Stewart, Kolasch & Birch, LLP

(57) ABSTRACT

A method for locally adjusting the glossiness of a printed image includes printing an image onto a recording medium in multiple swaths and locally adjusting the ink volume for each swath. A printer for printing an image onto a recording medium includes a control unit configured to perform the method.

19 Claims, 4 Drawing Sheets

METHOD FOR LOCALLY ADJUSTING GLOSS WHILE PRINTING AN IMAGE

CROSS-REFERENCE TO RELATED APPLICATIONS

This application claims priority under 35 U.S.C. § 119(a) to Application No. 18200521.5, filed in Europe on Oct. 15, 2018, the entirety of which is expressly incorporated herein by reference.

BACKGROUND OF THE INVENTION

1. Field of the Invention

An embodiment of the present invention relates to a method for printing an image onto a recording medium by jetting an ink, in particular a radiation curable gelling ink, in multiple swaths using an inkjet printer onto the recording medium, whereby the glossiness of the image is locally adjusted. Further, an embodiment of the present invention relates to a printer for printing an image onto a recording medium configured for performing such a method.

2. Background of the Invention

Methods for printing an image onto a recording medium using a radiation curable ink composition are known in the background art. In general, such methods comprise the step of applying a UV curable ink onto a recording medium by, for instance, jetting droplets of ink using an ink jet printer. The image may be printed by jetting all the droplets of ink constituting the image in a single pass or swath, or may be printed by distributing the jetting of the droplets of ink constituting the image over multiple passes or swaths.

Furthermore, it is known to control the gloss of the printed image to change the appearance of the image, or parts of the image, for aesthetic purposes. Generally, such methods comprise the application of a clear ink, also known as varnish, to adjust the glossiness of the image or parts of the image. This however requires additional material in the form of a clear ink and additional production time for applying such clear ink on top of the printed image or parts of the image.

It is therefore an object of the present invention to overcome the disadvantage of the known art by providing a method for printing an image onto a recording medium, wherein the gloss may be locally adjusted without the need of additional material or additional production time.

SUMMARY OF THE INVENTION

The object of the present invention is achieved in a method for printing an image onto a recording medium in n swaths in accordance with an image file comprising a gloss map, n being an integer of at least 2, wherein the method comprises the steps of: determining a total ink volume to be printed on a first area of the recording medium thereby determining the total thickness of the ink layers to be printed for said first area; determining a gloss level for said first area from the gloss map; determining an ink layer thickness profile for said first area based on the determined gloss level; setting an ink volume to be printed for each swath for said first area thereby setting an ink volume distribution for said first area; jetting an ink with a first volume in a first swath for said first area; jetting an ink with a second volume in a second swath for said first area, wherein the second volume may be different than the first volume; jetting an ink with a third volume in m swaths, wherein m=n−2, wherein the third volume may be different from the first and/or second volume; and curing the jetted ink, wherein the sum of the first volume, the second volume and the third volume equals the total ink volume.

The gloss map comprised in the image file comprises information on the glossiness of the image or of parts of the image. The gloss map may be generated and comprised in the image file when generating the image file with imaging software, manually and/or automatically, or the gloss map may be generated and comprised in the image file by an operator of a printer on the user interface of the printer. The gloss map may comprise information in the form of settings and/or values for any given area in the image. For instance, the gloss map may comprise a value for the glossiness of a first area in the image, which informs the printer printing the image that this first area should have a glossy appearance, while the rest of the image should have a matt appearance. Based upon the image file, a total ink volume for any given area, such as the first area, may be determined, setting the total thickness of the ink layers to be printed for said area, thereby setting the total ink volume which suitably covers said area with ink in correspondence with the image file. Based upon the gloss map, a gloss level for any given area, such as the first area, may be determined, setting the glossiness for said area, thereby determining if said area should appear glossy or matt. Based on the glossiness for any given area, such as the first area, the ink layer thickness for each ink layer to be printed by each pass or swath, in relation to the total ink layer thickness for suitably covering said area, is determined, thereby setting an ink layer thickness profile for said area. When jetting the ink in multiple swaths in accordance with said ink layer thickness profile, the resulting printed area may have a gloss level in accordance with the determined gloss level. Thus, the resulting printed area may have a glossy or a matt appearance. The number of swaths, wherein an image is built, may be suitably selected. In an embodiment of the present invention, the number of swaths may be n, wherein n is an integer of at least 2. For example, n may be selected from 2, 3, 4, 6 or 8. In each swath, a sub-layer may be formed. The first to the nth sub-layer may form the ink layer.

When printing a swath, a certain ink volume is applied onto the recording medium. The volume of ink applied onto the recording medium may differ for different swaths. For instance, a first ink sub-layer printed in a first swath for a first area may be thicker than a second ink sub-layer printed in a second swath for the first area, resulting in a glossiness different than the glossiness of a second area in which the first ink sub-layer printed in a first swath for the second area is equal to or thinner than a second ink sub-layer printed in a second swath for said second area, wherein the total thickness of said first and second area may be equal. Based upon the ink layer thickness profile, an ink volume for each swath to be printed for any given area, such as the first area, is determined, setting the ink volume needed to result in the ink layer thickness as desired for each ink sub-layer jetted in each swath, thereby setting an ink volume distribution. Based upon the ink volume distribution, ink may be jetted with a first volume for a first swath and with a second volume for a second swath in a given area. A third volume may be jetted for the subsequent m swaths (wherein m=n−2), resulting in a printed area wherein the ink sub-layers constituting the printed area have a thickness corresponding to the determined ink layer thickness profile, which results in a printed area having a glossiness in accordance with the gloss map for said printed area.

The image is built up in at least two swaths. Optionally, more than two swaths are used. When only two swaths are needed, m is zero and no third swath is applied. In that case, the third ink volume is zero. When more than two swaths are used (n>2), then m swaths (m=n−2) are applied. The total ink volume applied in these m swaths is the third ink volume. The third ink volume may be equally divided over the m swaths or may not be equal for the m swaths. The ink volume applied per swath may be the same or different than the first ink volume and/or the second ink volume. The total amount of ink applied during the n swaths, i.e. the sum of the first ink volume, the second ink volume and the third ink volume, equals the total ink volume.

After jetting the ink, the jetted ink may be cured and thereby the jetted ink is fixed. The jetted ink may be cured using a source of electromagnetic radiation suitable for curing the ink. Said source may be, for instance, a UV radiation source, such as a UV lamp.

In an embodiment, the first volume in the first swath is lower than the second volume in the second swath. In this embodiment, the first ink sub-layer jetted by the first swath is thinner than the second ink sub-layer jetted by the second swath due to the first volume being less than the second volume. When the ink is cured after the first swath is jetted and before the second swath is jetted, the resulting printed area may appear gloss. When the ink is cured only after both the first and second swath are jetted, the resulting printed area may appear matt.

In an embodiment, the first volume in the first swath is higher than the second volume in the second swath. In this embodiment, the first ink sub-layer jetted by the first swath is thicker than the second ink sub-layer jetted by the second swath due to the first volume being higher than the second volume. When the ink is cured after the first swath is jetted and before the second swath is jetted, the resulting printed area may appear matt. When the ink is cured only after both the first and second swath are jetted, the resulting printed area may appear glossy.

In an embodiment, the first volume in the first swath essentially is the same as the second volume in the second swath. In this embodiment, the resulting thickness of the first ink sub-layer jetted by the first swath is essentially the same as the thickness of the second ink sub-layer jetted by the second swath. When the ink is cured after the first swath is jetted and before the second swath is jetted, the resulting printed area may have a glossiness that appears in between glossy and matt. When the ink is cured only after both the first and second swath are jetted, the resulting printed area may have a glossiness that appears in between glossy and matt.

In an embodiment, the jetted ink is cured after the first swath is jetted and before the second swath is jetted. In this embodiment, the resulting printed area may appear glossy when the first volume in the first swath is lower than the second volume in the second swath, or the resulting printed area may appear matt when the first volume in the first swath is higher than the second volume in the second swath, or the resulting printed area may have a glossiness appearing in between glossy and matt when the first volume in the first swath is essentially the same as the second volume in the second swath.

In an embodiment, the jetted ink is cured only after jetting the nth swath. In this embodiment, the resulting printed area may appear matt when the first volume in the first swath is lower than the second volume in the second swath, or the resulting printed area may appear glossy when the first volume in the first swath is higher than the second volume in the second swath, or the resulting printed area may have a glossiness appearing in between glossy and matt when the first volume in the first swath is essentially the same as the second volume in the second swath.

In an aspect of the invention, a printer for printing an image onto a recording medium is provided, wherein the printer comprises: a printhead for jetting an ink composition onto a recording medium; a radiation source for curing the ink composition jetted onto the recording medium by the printhead; and a control unit configured to perform the method for printing an image onto a recording medium as described above.

The printer is configured to, in operation, perform the method for printing an image onto a recording medium as described above. The control unit may further control the printhead and the radiation source in accordance with the method as described above.

In an embodiment, the radiation source for curing the ink composition is a UV radiation source. In this embodiment, the radiation source is suitable for curing the UV radiation curable gelling ink. The UV radiation source may emit UV radiation at varying intensities thereby either partially or fully curing the jetted ink composition.

In an embodiment, the UV radiation source is a UV LED lamp. In this embodiment, the UV radiation is emitted by a UV LED lamp. The LED lamp may emit UV radiation at varying intensities thereby either partially or fully curing the ink composition jetted.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1A:
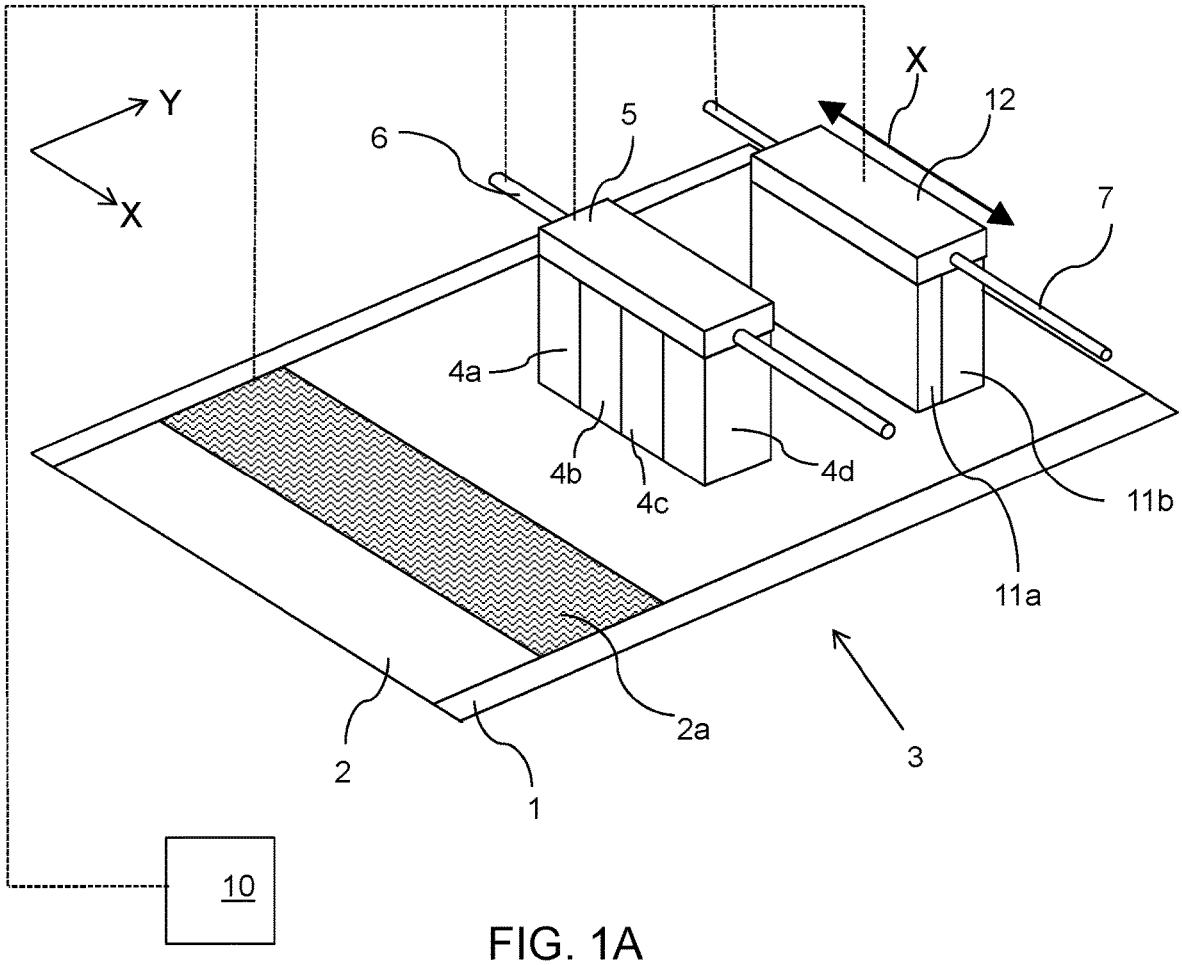
FIG. 1A is a schematic representation of an inkjet printing system.

The present invention will now be described with reference to the accompanying drawings, wherein the same reference numerals have been used to identify the same or similar elements throughout the several views.

Printing Assembly

Figure 1B:
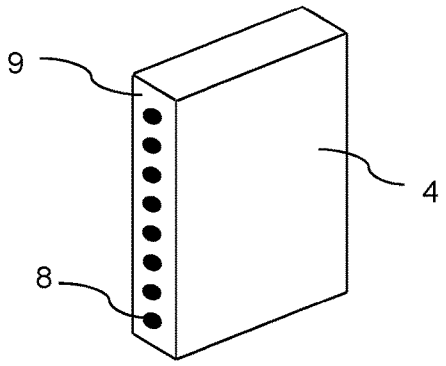
FIG. 1B is a schematic representation of an inkjet print head.

FIG. 1A schematically illustrates an ink jet printing assembly 3. The ink jet printing assembly 3 comprises a supporting configured to support an image receiving medium 2. The support is shown in FIG. 1A as a flat surface 1, but alternatively, the support may be a platen, for example a rotatable drum that is rotatable around an axis. The support may optionally be provided with suction holes for holding the image receiving medium in a fixed position with respect to the support. The ink jet printing assembly 3 comprises print heads 4*a*-4*d*, mounted on a scanning print carriage 5. The scanning print carriage 5 is guided by a suitable guide 6 to move in reciprocation in the main scanning direction X. Each print head 4*a*-4*d* comprises an orifice surface 9 provided with at least one orifice 8, as is shown in FIG. 1B. The print heads 4*a*-4*d* are configured to eject droplets of marking material onto the image receiving medium 2.

The image receiving medium 2 may be a medium in web or in sheet form and may be composed of, e.g. paper, cardboard, label stock, coated paper, plastic or textile. Alternatively, the image receiving medium 2 may also be an intermediate member, endless or not. Examples of endless members, which may be moved cyclically, are a belt or a drum. The image receiving medium 2 is moved in the sub-scanning direction Y over the flat surface 1 along four print heads 4*a*-4*d* provided with a fluid marking material.

The image receiving medium 2, as depicted in FIG. 1A is locally heated or cooled in the temperature control region 2*a*. In the temperature control region 2A, temperature control (not shown), such as a heater and/or cooler may be provided to control the temperature of the receiving medium 2. Optionally, the temperature control may be integrated in the support for supporting an image receiving medium 2. The temperature control may be an electrical temperature control. The temperature control may use a cooling and/or heating liquid to control the temperature of the image receiving medium 2. The temperature control may further comprise a sensor (not shown) for monitoring the temperature of the image receiving medium 2.

A scanning print carriage 5 carries the four print heads 4*a*-4*d* and may be moved in reciprocation in the main scanning direction X parallel to the platen 1, such as to enable scanning of the image receiving medium 2 in the main scanning direction X. Only four print heads 4*a*-4*d* are depicted for demonstrating the invention. In practice, an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material, is present. Alternatively, a black-and-white printer may comprise a white marking material, which is to be applied on a black image-receiving medium 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by a guide 6. The guide 6 may be a rod as depicted in FIG. 1A. Although only one rod 6 is depicted in FIG. 1A, a plurality of rods may be used to guide the carriage 5 carrying the print heads 4. The rod may be driven by a suitable drive (not shown). Alternatively, the carriage 5 may be guided by other guides, such as an arm being able to move the carriage 5. Another alternative is to move the image receiving material 2 in the main scanning direction X.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 are arranged in a single linear array parallel to the sub-scanning direction Y, as is shown in FIG. 1B. Alternatively, the orifices 8 may be arranged in the main scanning direction X. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays.

As depicted in FIG. 1A, the respective print heads 4*a*-4*d* are placed parallel to each other. The print heads 4*a*-4*d* may be placed such that corresponding orifices 8 of the respective print heads 4*a*-4*d* are positioned in-line in the main scanning direction X. This means that a line of image dots in the main scanning direction X may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively, multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction X. The image dots are formed by ejecting droplets of marking material from the orifices 8.

The ink jet printing assembly 3 may further comprise a curing device 11*a*, 11*b*. As shown in FIG. 1A, a scanning print carriage 12 carries the two curing devices 11*a*, 11*b* and may be moved in reciprocation in the main scanning direction X parallel to the platen 1, such as to enable scanning of the image receiving medium 2 in the main scanning direction X. Alternatively, more than two curing devices may be applied. It is also possible to apply page-wide curing devices. If page-wide curing devices are provided, then it may not be necessary to move the curing device in reciprocation in the main scanning direction X. The first curing device 11*a* may emit a first beam of UV radiation, the first beam having a first intensity. The first curing device 11*a* may be configured to provide the radiation for the pre-curing step. The second curing device 11*b* may emit a second beam of radiation, the second beam of radiation having a second intensity. The second curing device 11*b* may be configured to provide the radiation for the post-curing step.

The carriage 12 is guided by a guide 7. The guide 7 may be a rod as depicted in FIG. 1A. Although only one rod 7 is depicted in FIG. 1A, a plurality of rods may be used to guide the carriage 12 carrying the curing devices 11*a*, 11*b*. The rod 7 may be driven by a suitable drive (not shown). Alternatively, the carriage 12 may be guided by other guides, such as an arm being able to move the carriage 12.

The curing devices 11*a*, 11*b* may be energy sources, such as actinic radiation sources, accelerated particle sources or heaters. Examples of actinic radiation sources are UV radiation sources or visible light sources. UV radiation sources are preferred, because they are particularly suited to cure UV curable inks by inducing a polymerization reaction in such inks. Examples of suitable sources of such radiation are lamps, such as mercury lamps, xenon lamps, carbon arc lamps, tungsten filaments lamps, light emitting diodes (LED's) and lasers. In the embodiment shown in FIG. 1A, the first curing device 11*a* and the second curing device 11*b* are positioned parallel to one another in the sub scanning direction Y. The first curing device 11*a* and the second curing device 11*b* may be the same type of energy source or may be a different type of energy source. For example, when the first and second curing devices 11*a*, 11*b*, respectively, both emit actinic radiation, the wavelength of the radiated emitted by the two respective curing devices 11*a*, 11*b* may differ or may be the same. The first and second curing devices are depicted as distinct devices. However, alternatively, only one source of UV radiation emitting a spectrum of radiation may be used, together with at least two distinct filters. Each filter may absorb a part of the spectrum, thereby providing two beams of radiation, each one having an intensity different from the other.

The flat surface 1, the temperature control, the carriage 5, the print heads 4*a*-4*d*, the carriage 12 and the first and second curing devices 11*a*, 11*b* are controlled by a suitable control 10.

Methods for Printing

FIGS. 2A to 2D are schematic representations of a method for printing an image according to an embodiment of the invention, comprising the steps of jetting an ink with a first volume in a first swath for said first area, jetting an ink with a second volume in a second swath for said first area, and curing the jetted ink.

Figure 2A:
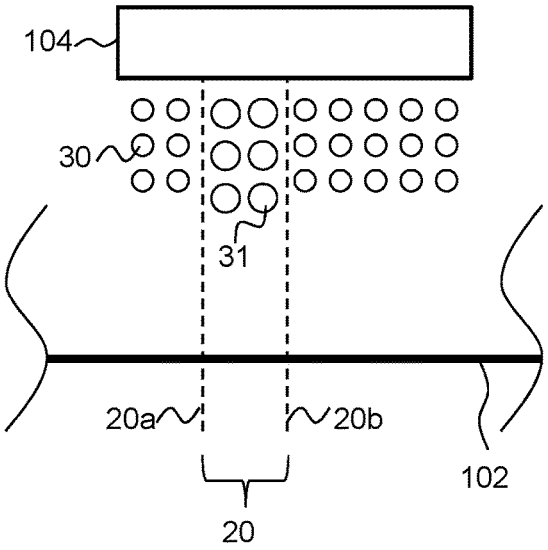
FIGS. 2A-2D are schematic representations of a method according to a first exemplary embodiment of the present invention.

FIG. 2A illustrates a side view of a print medium 102 and a print head 104 configured to, in operation, jet droplets 30 and 31 of an ink composition. A first area 20 is a part of the print medium extending in a direction perpendicular to the print medium, as represented by dashed lines 20*a* and 20*b*. In FIG. 2A, the printer has determined the total ink volume for a first area 20, the total ink layer thickness for said first area 20, the gloss level for said first area 20, set an ink volume for each swath for said first area 20, and is currently jetting a first swath of droplets 30 and 31 of an ink composition onto the print medium 102, wherein the droplets 31 jetted onto the print medium 102 at the first area 20 are larger than the droplets 30 jetted onto the second area of the print medium 102, thus a higher ink volume will be printed at the first area 20 for the first swath. Alternatively, or additionally, a higher amount of droplets 31 may have been jetted instead of larger droplets 31 onto the print medium 102 at the first area 20 (not shown). After the first swath of droplets 30 and 31 have been jetted, forming a first sub-layer of ink onto the print medium 102, a second swath of droplets 30 and 31 will be jetted as shown in FIG. 2B.

Figure 2B:
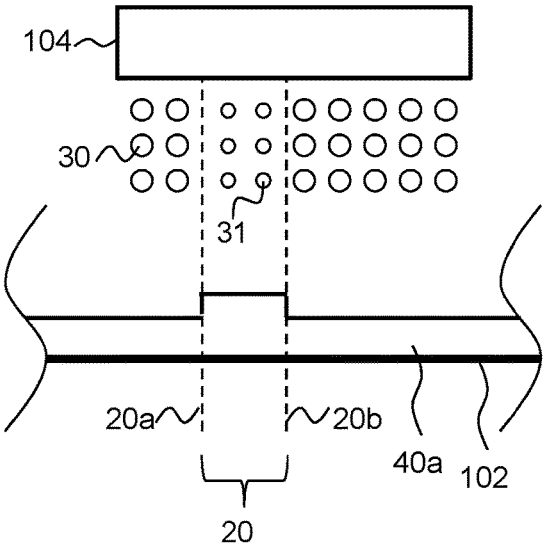

FIG. 2B illustrates the print medium 102 on which a first sub-layer of ink 40*a* has been formed by the first swath of droplets 30 and 31 as shown in FIG. 2A. In FIG. 2B, the first sub-layer of ink 40*a* jetted by the first swath is thicker at the first area 20 than at the second area of the first sub-layer of ink 40*a*. As shown, a second swath of droplets 30 and 31 are jetted onto the first sub-layer of ink 40*a*, wherein the droplets 31 jetted onto the first sub-layer of ink 40*a* at the first area 20 are smaller than the droplets 30 jetted onto the second area of the first sub-layer of ink 40*a*, and thus a lower ink volume will be printed at the first area 20 for the second swath. Alternatively, or additionally, a lower amount of droplets 31 may have been jetted instead of smaller droplets 31 jetted onto the second area of the first sub-layer of ink 40*a* (not shown). After the second swath of droplets 30 and 31 have been jetted, a second sub-layer of ink is formed on top of the first sub-layer of ink 40*a* as shown in FIG. 2C.

Figure 2C:
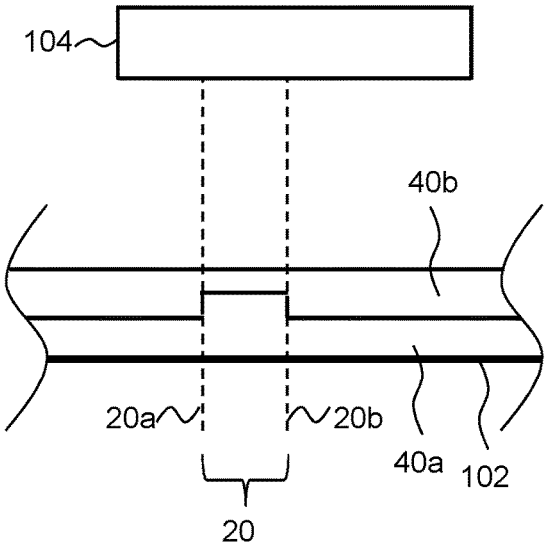

FIG. 2C illustrates the print medium 102 on which a second sub-layer of ink 40*b* has been formed by the second swath of droplets 30 and 31 as shown in FIG. 2B. In FIG. 2C, the second sub-layer of ink 40*b* jetted by the second swath is thinner at the first area 20 than the first sub-layer of ink 40*a* jetted by the first swath at the first area 20. The total thickness of both the first sub-layer of ink 40*a* and the second sub-layer of ink 40*b* combined at the first area 20 is the same as the total thickness of both sub-layers combined along the second area of the print medium 102. With both the first sub-layer of ink 40*a* and the second sub-layer of in 40*b*, both sub-layers may be cured as shown in FIG. 2D.

Figure 2D:
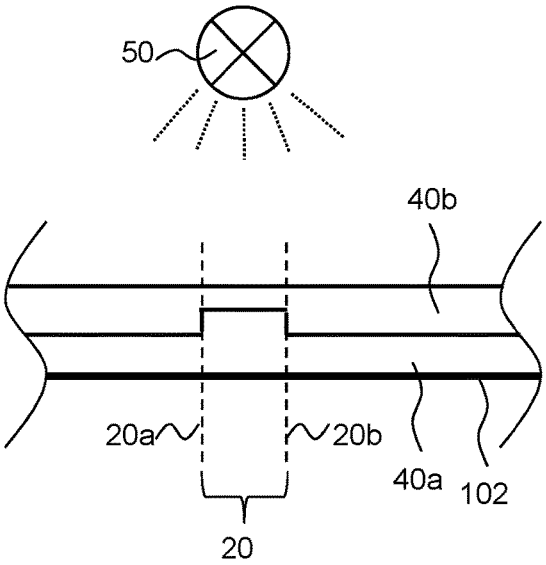

FIG. 2D illustrates the print medium on which both the first sub-layer of ink 40*a* and the second sub-layer of ink 40*b* have been formed and are subjected to UV light irradiated by a UV radiation source 50. By subjecting both sub-layers of ink 40*a* and 40*b* to UV radiation, the ink is cured and thereby the resulting image is fixed. The gloss level of the image at the first area 20 may be different than the gloss level at the second area of the image along the print medium 102. In FIG. 2D, the image at the first area 20 may appear more glossy than the second area of the image along the print medium 102.

FIGS. 3A to 3D are schematic representations of a method for printing an image according to an embodiment of the invention comprising the steps of jetting an ink with a first volume in a first swath for said first area, curing a first sub-layer of jetted ink, jetting an ink with a second volume in a second swath for said first area, and curing a second sub-layer of jetted ink.

Figure 3A:
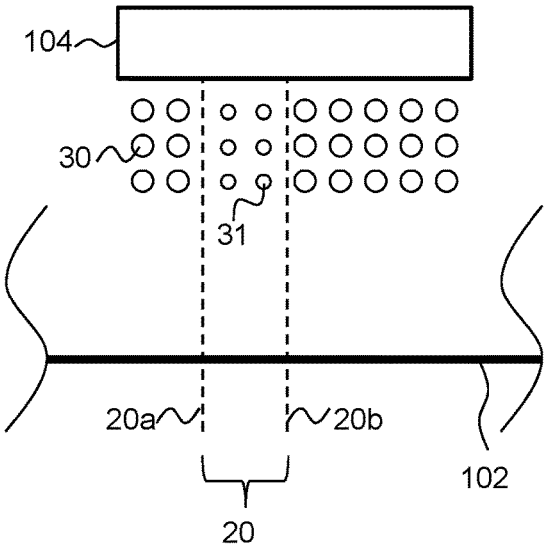
FIGS. 3A-3D are schematic representations of a method according to a second exemplary embodiment of the present invention.

FIG. 3A illustrates a side view of a print medium 102 and a print head 104 configured to, in operation, jet droplets 30 and 31 of an ink composition. A first area 20 is a part of the print medium extending in a direction perpendicular to the print medium as represented by dashed lines 20*a* and 20*b*. In FIG. 3A, the printer has determined the total ink volume for a first area 20, the total ink layer thickness for said first area 20, the gloss level for said first area 20, set an ink volume for each swath for said first area 20, and is currently jetting a first swath of droplets 30 and 31 of an ink composition onto print medium 102, wherein the droplets 31 jetted onto the print medium 102 at the first area 20 are smaller than the droplets 30 jetted onto the second area of the print medium 102, thus a lower ink volume will be printed at the first area 20 for the first swath. Alternatively, or additionally, a lower amount of droplets 31 may have been jetted instead of smaller droplets 31 onto the print medium 102 at the first area 20 (not shown). After the first swath of droplets 30 and 31 have been jetted, forming a first sub-layer of ink onto the print medium 102, the first sub-layer of ink may be cured as shown in FIG. 3B.

Figure 3B:
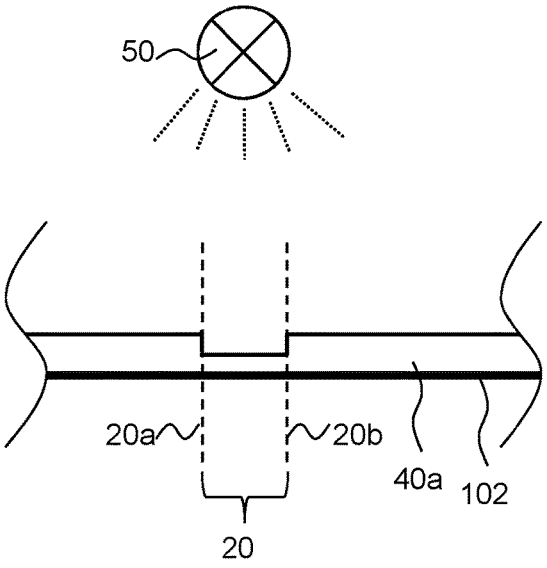

FIG. 3B illustrates the print medium 102 on which a first sub-layer of ink 40*a* has formed by the first swath of droplets 30 and 31 as shown in FIG. 3A and is subjected to UV light irradiated by a UV radiation source 50. In FIG. 3B, the first sub-layer of ink 40*a* jetted by the first swath is thinner at the first area 20 than at the second area of the first sub-layer of ink 40*a*. By subjecting the first sub-layer of ink 40*a* to UV radiation, the ink is cured and thereby the first sub-layer of ink 40*a* is fixed. After curing the first sub-layer of ink 40*a*, a second sub-layer of ink may be formed on top of the cured, first sub-layer of ink 40*a*, as shown in FIG. 3C.

Figure 3C:
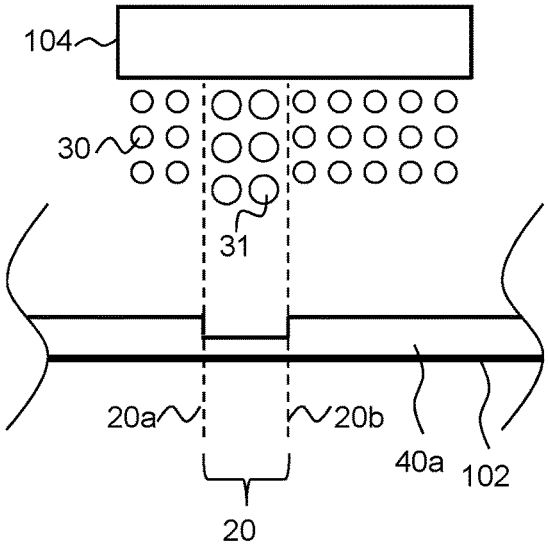

FIG. 3C illustrates the print medium 102 on which a first sub-layer of ink 40*a* has been cured by UV radiation as shown in FIG. 3B. In FIG. 3C, a second swath of droplets 30 and 31 of an ink composition is jetted onto the first sub-layer of ink 40*a*, wherein the droplets 31 jetted onto the first sub-layer 40*a* at the first area 20 are larger than the droplets 30 jetted onto the second area of the first sub-layer 40*a*, thus a higher ink volume will be printed at the first area 20 for the second swath. Alternatively, or additionally, a higher amount of droplets 31 may have been jetted instead of larger droplets 31 onto the first sub-layer 40*a* at the first area 20 (not shown). After the second swath of droplets 30 and 31 have been jetted, a second sub-layer of ink is formed on top of the first sub-layer of ink 40*a*, and the second sub-layer may be cured as shown in FIG. 3D.

Figure 3D:
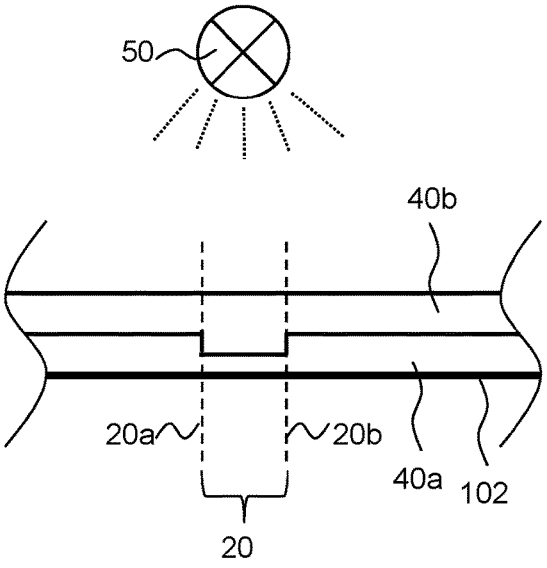

FIG. 3D illustrates the print medium on which the second sub-layer of ink 40*b* has been formed on top of the first sub-layer of ink 40*a*, and is subjected to UV light irradiated by the UV radiation source 50. By subjecting the second sub-layer of ink 40*b* to UV radiation, the ink in said second sub-layer is cured and thus the second sub-layer of ink 40*b* is fixed, thereby also fixing the resulting image. The gloss level of the image at the first area 20 may be different than the gloss level at the second area of the image along the print medium 102. In FIG. 3D, the image at the first area 20 may appear more glossy than the second area of the image along the print medium 102.

Exemplary Images

FIGS. 4A to 4D are schematic representations of the side view of examples of a third to sixth embodiment of the invention.

Figure 4A:
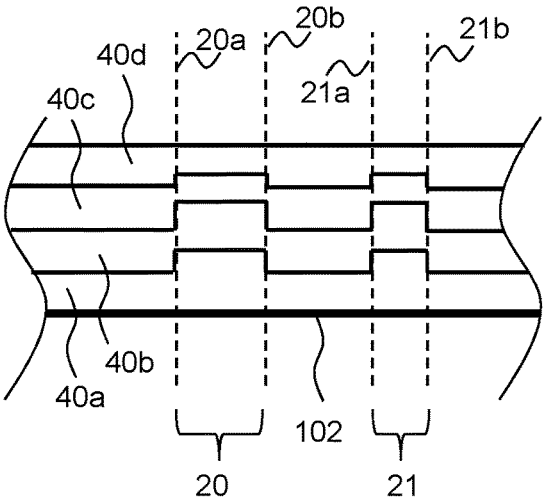
FIGS. 4A-4D are schematic representations of the side view of examples of a third to sixth embodiment of the present invention.

FIG. 4A illustrates an exemplary resulting image in which four sub-layers 40*a*, 40*b*, 40*c*, and 40*d* have been formed by jetting droplets of an ink composition in four different swaths onto print medium 102. Further, a first area 20 being a part of the print medium extending in a direction perpendicular to the print medium as represented by dashed lines 20*a* and 20*b* is shown, as well as a third area 21 being a part of the print medium extending in a direction perpendicular to the print medium as represented by dashed lines 21*a* and 21*b*. In FIG. 4A, the total ink layer thickness for the first area 20 is the same as the total ink layer thickness of the second area of the total ink layer along the second area of the print medium 102, and as the total ink layer thickness of the third area 21. As shown, the thickness for each sub-layer 40*a*, 40*b*, 40*c*, and 40*d* differs at both the first area 20 and the third area 21, in comparison to the thickness for each sub-layer 40*a*, 40*b*, 40*c*, and 40*d* at the second area. The gloss level of the image at the first area 20 and the third area 21 may be different than the gloss level at the second area of the image along the print medium 102. The gloss level of the image at the first area 20 may be the same as the gloss level of the image at the third area 21.

Figure 4B:
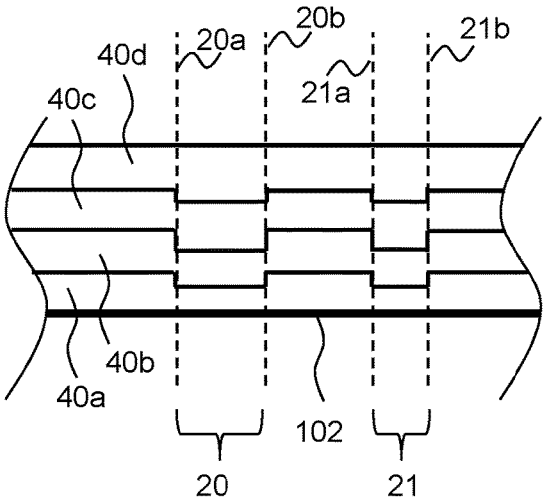

FIG. 4B illustrates an exemplary resulting image in which four sub-layers 40*a*, 40*b*, 40*c*, and 40*d* have been formed by jetting droplets of an ink composition in four different swaths onto print medium 102. Further, a first area 20 being a part of the print medium extending in a direction perpendicular to the print medium as represented by dashed lines 20*a* and 20*b* is shown, as well as a third area 21 being a part of the print medium extending in a direction perpendicular to the print medium as represented by dashed lines 21*a* and 21*b*. In FIG. 4B, the total ink layer thickness for the first area 20 is the same as the total ink layer thickness of the second area of the total ink layer along the second area of the print medium 102, and as the total ink layer thickness of the third area 21. As shown, the thickness for each sub-layer 40*a*, 40*b*, 40*c*, and 40*d* differs at both the first area 20 and the third area 21 in comparison to the thickness for each sub-layer 40*a*, 40*b*, 40*c*, and 40*d* at the second area. The gloss level of the image at the first area 20 and the third area 21 may be different than the gloss level at the second area of the image along the print medium 102. The gloss level of the image at the first area 20 may be the same as the gloss level of the image at the third area 21.

Figure 4C:
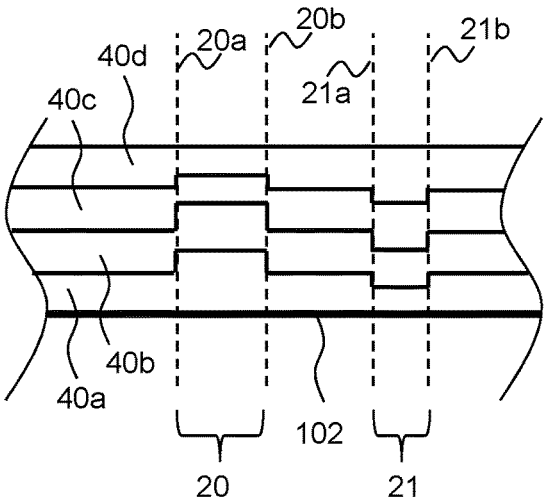

FIG. 4C illustrates an exemplary resulting image in which four sub-layers 40*a*, 40*b*, 40*c*, and 40*d* have been formed by jetting droplets of an ink composition in four different swaths onto print medium 102. Further, a first area 20 being a part of the print medium extending in a direction perpendicular to the print medium as represented by dashed lines 20*a* and 20*b* is shown, as well as a third area 21 being a part of the print medium extending in a direction perpendicular to the print medium as represented by dashed lines 21*a* and 21*b*. In FIG. 4C, the total ink layer thickness for the first area 20 is the same as the total ink layer thickness of the second area of the total ink layer along the second area of the print medium 102, and as the total ink layer thickness of the third area 21. As shown, the thickness for each sub-layer 40*a*, 40*b*, 40*c*, and 40*d* differ at both the first area 20 and the third area 21 in comparison to each other and to the total ink layer thickness of each sub-layer 40*a*, 40*b*, 40*c*, and 40*d* at the second area. The gloss level of the image at the first area 20 and the third area 21 may be different than the gloss level at the second area of the image along the print medium 102. The gloss level of the image at the first area 20 may also be different as the gloss level of the image at the third area 21.

Figure 4D:
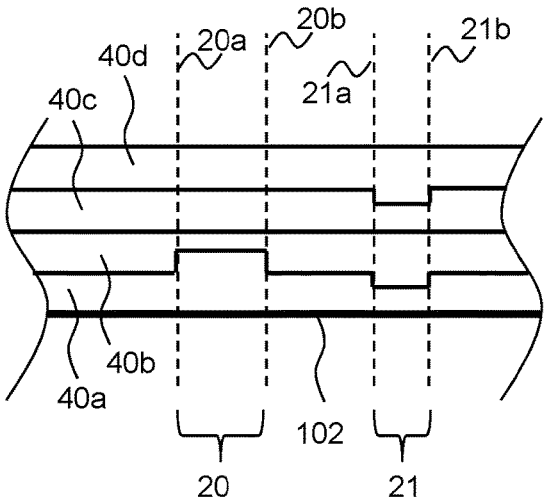

FIG. 4D illustrates an exemplary resulting image in which four sub-layers 40*a*, 40*b*, 40*c*, and 40*d* have been formed by jetting droplets of an ink composition in four different swaths onto print medium 102. Further, a first area 20 being a part of the print medium extending in a direction perpendicular to the print medium as represented by dashed lines 20*a* and 20*b* is shown, as well as a third area 21 being a part of the print medium extending in a direction perpendicular to the print medium as represented by dashed lines 21*a* and 21*b*. In FIG. 4D, the total ink layer thickness for the first area 20 is the same as the total ink layer thickness of the second area of the total ink layer along the second area of the print medium 102, and as the total ink layer thickness of the third area 21. As shown, the thickness for each sub-layer 40*a*, 40*b*, 40*c*, and 40*d* differ at both the first area 20 and the third area 21 in comparison to each other and to the total ink layer thickness of each sub-layer 40*a*, 40*b*, 40*c*, and 40*d* at the second area. The gloss level of the image at the first area 20 and the third area 21 may be different than the gloss level at the second area of the image along the print medium 102. The gloss level of the image at the first area 20 may also be different as the gloss level of the image at the third area 21.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for printing an image onto a recording medium in n swaths in accordance with an image file comprising a gloss map, n being an integer of at least 2, wherein the method comprises the steps of:

determining a total ink volume to be printed on a first area of the recording medium, thereby determining the total thickness of the ink layers to be printed for said first area;

determining a gloss level for said first area from the gloss map;

determining an ink layer thickness profile for said first area based on the determined gloss level;

setting an ink volume to be printed for each swath for said first area, thereby setting an ink volume distribution for said first area;

jetting an ink with a first volume in a first swath for said first area;

jetting an ink with a second volume in a second swath for said first area, wherein the second volume may be different than the first volume;

jetting an ink with a third volume in m swaths, wherein m=n−2, and wherein the third volume may be different from the first volume and/or the second volume; and curing the jetted ink, wherein the sum of the first volume, the second volume and the third volume equals the total ink volume.

2. The method according to claim 1, wherein the first volume in the first swath is lower than the second volume in the second swath.

3. The method according to claim 2, wherein the jetted ink is cured after the first swath is jetted and before the second swath is jetted.

4. The method according to claim 2, wherein the jetted ink is cured after the first swath is jetted and before the second swath is jetted.

5. A printer for printing an image onto a recording medium, wherein the printer comprises:

a printhead for jetting an ink composition onto a recording medium;

a radiation source for curing the ink composition jetted onto the recording medium by the printhead; and a control configured to perform the method according to claim 2.

6. The method according to claim 1, wherein the first volume in the first swath is higher than the second volume in the second swath.

7. The method according to claim 6, wherein the jetted ink is cured after the first swath is jetted and before the second swath is jetted.

8. The method according to claim 6, wherein the jetted ink is cured after the first swath is jetted and before the second swath is jetted.

9. A printer for printing an image onto a recording medium, wherein the printer comprises:

a printhead for jetting an ink composition onto a recording medium;

a radiation source for curing the ink composition jetted onto the recording medium by the printhead; and a control configured to perform the method according to claim 6.

10. The method according to claim 1, wherein the first volume in the first swath is essentially the same as the second volume in the second swath.

11. The method according to claim 10, wherein the jetted ink is cured after the first swath is jetted and before the second swath is jetted.

12. The method according to claim 10, wherein the jetted ink is cured after the first swath is jetted and before the second swath is jetted.

13. A printer for printing an image onto a recording medium, wherein the printer comprises:

a printhead for jetting an ink composition onto a recording medium;

a radiation source for curing the ink composition jetted onto the recording medium by the printhead; and a control configured to perform the method according to claim 10.

14. The method according to claim 1, wherein the jetted ink is cured after the first swath is jetted and before the second swath is jetted.

15. The method according to claim 1, wherein the jetted ink is cured only after jetting the $n^{th}$ swath.

16. A printer for printing an image onto a recording medium, wherein the printer comprises:

a printhead for jetting an ink composition onto a recording medium;

a radiation source for curing the ink composition jetted onto the recording medium by the printhead; and a control configured to perform the method according to claim 1.

17. The printer according to claim 16, wherein the radiation source for curing the ink composition is a UV radiation source.

18. The printer according to claim 17, wherein the UV radiation source is a UV LED lamp.

19. A method for printing an image onto a recording medium in n swaths in accordance with an image file comprising a gloss map, n being an integer of at least 2, wherein the method comprises the steps of:

determining a total colored ink volume to be printed on a first area of the recording medium, thereby determining the total thickness of the ink layers to be printed for said first area;

determining a gloss level for said first area from the gloss map;

determining an ink layer thickness profile for said first area based on the determined gloss level;

setting a colored ink volume to be printed for each swath for said first area, thereby setting an ink volume distribution for said first area;

jetting a colored ink with a first volume in a first swath for said first area;

jetting a colored ink with a second volume in a second swath for said first area, wherein the second volume may be different than the first volume;

jetting a colored ink with a third volume in m swaths, wherein m=n−2, and wherein the third volume may be different from the first volume and/or the second volume; and curing the jetted ink, wherein the sum of the first volume, the second volume and the third volume equals the total ink volume.

* * * * *